US009532602B2

(12) United States Patent
Liu

(10) Patent No.: US 9,532,602 B2
(45) Date of Patent: Jan. 3, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 536 days.

(21) Appl. No.: 14/055,409

(22) Filed: Oct. 16, 2013

(65) Prior Publication Data

US 2015/0020827 A1 Jan. 22, 2015

(30) Foreign Application Priority Data

Jul. 22, 2013 (CN) ..... 2013 2 0438669 U

(51) Int. Cl.
*A24F 47/00* (2006.01)

(52) U.S. Cl.
CPC ..... *A24F 47/008* (2013.01)

(58) Field of Classification Search
USPC ..... 131/329, 330, 347; 128/200.14, 202.21
See application file for complete search history.

(56) References Cited

U.S. PATENT DOCUMENTS

2014/0020696 A1* 1/2014 Liu ..... A24F 47/002 131/329
2015/0013701 A1* 1/2015 Liu ..... A24F 47/008 131/329
2015/0020828 A1* 1/2015 Liu ..... A24F 47/008 131/329
2015/0027464 A1* 1/2015 Liu ..... A24F 47/008 131/329
2015/0059784 A1* 3/2015 Liu ..... A24F 47/008 131/329

OTHER PUBLICATIONS

Definition of groove, Merriam-Webster, no date, [online], retrieved from the Internet, [retrieved Mar. 12, 2016], <URL: http://www.merriam-webster.com/dictionary/groove>.*
Definition of buckle, the free dictionary by Farlex, no date, [online], retrieved from the Internet, [retrieved Mar. 12, 2016], <URL: http://www.thefreedictionary.com/buckle>.*

* cited by examiner

*Primary Examiner* — Dennis Cordray
(74) *Attorney, Agent, or Firm* — Tim Tingkang Xia, Esq.; Locke Lord LLP

(57) ABSTRACT

An electronic cigarette comprising an atomizing assembly and a battery assembly is provided. A connection structure is mounted at a butt-joint position between the atomizing assembly and the battery assembly, and the connection structure includes a first connection member and a second connection member; a buckle protrudes from an outer side of the first connection member; a guiding groove matching with the buckle is defined in an inner side of the second connection member, and a buckling groove is defined in the circumference of the inner wall of the second connection member, and the buckling groove communicates with the guiding groove and is configured to enable the buckle to slide therein; the buckle is inserted into the second connection member along the guiding groove and is rotated along the buckling groove to connect the first connection member with the second connection member fixedly.

8 Claims, 7 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320438669.X filed in P.R. China on Jul. 22, 2013, the entire contents of which are hereby incorporated by reference.

FIELD OF THE APPLICATION

The present application relates to the field of electrically heating products, and more particularly relates to an electronic cigarette.

BACKGROUND OF THE APPLICATION

Generally, an electronic cigarette includes an atomizing assembly and a battery assembly. In conventional electronic cigarettes, the atomizing assemblies are usually connected with the battery assemblies by threads. Since the thread connection may be prone to misplace, have poor reliability, and be inconvenient to be disassembled, the performance of the electronic cigarettes may be adversely affected. In order to solve the above problems, in some electronic cigarettes in the prior art, a connecting method of direct insertion and tension or a connecting method of magnetic joint is adopted. However, since an electronic cigarette is a product for quitting smoking, whether the electronic cigarette can meet mental and physical demands of smokers and whether the electronic cigarette conforms to habits of smokers formed in many years will directly affect the effect for quitting smoking. The connecting method of direct insertion and tension and the connecting method of magnet joint not only have the drawback of insecure connections, but also change the habit that smokers generally like to connect the atomizing assembly with the battery assembly by rotation operations when using the electronic cigarette. Therefore, when a smoker uses an electronic cigarette using the aforementioned connecting methods, he or she may resist quitting smoking. In other words, the electronic cigarette may go against quitting smoking, and the user experience of the electronic cigarette is bad.

SUMMARY OF THE APPLICATION

The object of the present application is to provide an electronic cigarette which is convenient in assembly and stable in connection, aiming at the drawback that the connection between the atomizer assembly and the battery assembly of the electronic cigarette in the prior art is complex and unstable.

The technical schemes to solve the above technical problems are as follows.

In one aspect, an electronic cigarette comprising an atomizing assembly and a battery assembly connected together is provided. A connection structure is mounted at a butt-joint position between the atomizing assembly and the battery assembly, and the connection structure includes a first connection member and a second connection member, The first connection member includes a first outer electrode that is hollow and a first inner electrode that is inserted into the first outer electrode, a first insulation member is disposed between the first inner electrode and the first outer electrode, and the first insulation member includes a buckle that radially extends away from a central axis of the first connection member to the outside of the first outer electrode;

the second connection member defines a butt-joint groove, a sidewall of the butt-joint groove defines a guiding groove matching with the buckle, a buckling groove is defined in the circumference of one side of the guiding groove, and the buckling groove communicates with the guiding groove and is configured to enable the buckle to slide therein.

The buckle is inserted into the second connection member along the guiding groove and is rotated along the buckling groove to connect the first connection member with the second connection member fixedly.

In one embodiment, the first connection member is mounted on the atomizing assembly or the battery assembly, the second connection member is mounted on the battery assembly or the atomizing assembly.

In this embodiment, a sidewall of the first outer electrode defines a first buckling hole or a first buckling recess, and the buckle runs through the first buckling hole or the first buckling recess and protrudes from the outside of the first outer electrode.

In this embodiment, the first outer electrode includes a base portion and a rotate-to-buckle portion, a diameter of the rotate-to-buckle portion is less than a diameter of the base portion, and the buckle protrudes from the outside of the rotate-to-buckle portion.

In this embodiment, the buckle protrudes from a sidewall of the first insulation member and is integrated with the first insulation member, the first buckling hole or the first buckling recess is defined in a part of the rotate-to-buckle portion corresponding to the buckle, the buckle is buckled and matched with the first buckling hole or the first buckling recess, and the buckle protrudes from an outer wall of the rotate-to-buckle portion.

In this embodiment, the second connection member includes a second outer electrode that is hollow and a second inner electrode that is inserted into the second outer electrode, a second insulation member is disposed between the second inner electrode and the second outer electrode, a limiting member matched and buckled with the rotate-to-buckle portion is mounted on an end of the second outer electrode facing the first connection member, and the guiding groove matched with the buckle is defined in a part of an inner wall of the limiting member corresponding to the buckle.

In this embodiment, an annular shield ring is accommodated in the second outer electrode, and the buckling groove configured for enabling the buckle to slide therein is formed between the annular shield ring and the limiting member.

In this embodiment, at least one support member extends from one end of the limiting member that is away from an opening of the second outer electrode, the at least one support member is located symmetrically, and each support member is located between adjacent ones of the guiding grooves and configured to limit the buckle.

In this embodiment, the first connection member is mounted on one end of the atomizing assembly that is near the battery assembly; and the second connection member is mounted on one end of the battery assembly that is near the atomizing assembly.

In this embodiment, a heating assembly for atomizing tobacco tar is accommodated in the atomizing assembly, and the heating assembly is electrically connected to the first outer electrode and the first inner electrode respectively.

In this embodiment, the battery assembly includes a battery, the positive pole of the battery is electrically connected to one of the second outer electrode and the second inner electrode, and the negative pole of the battery is electrically connected to the other of the second outer electrode and the second inner electrode.

In this embodiment, an electrode cover is mounted between the battery and the second inner electrode, and any adjacent two of the second outer electrode, the second insulation member, and the electrode cover are limitedly connected together by interference fit.

In this embodiment, an accommodation space for containing the second inner electrode is formed between the electrode cover and the second insulation member, the accommodation space includes a first containing part near the limiting member and a second containing part near the battery, and a diameter of the second containing part is larger than a diameter of the first containing part; the second inner electrode runs through the first containing part and the second containing part and is then fixed; an annular limiting ring protrudes from the outer side of the second inner electrode, and the annular limiting ring is adjacent to a joint between the first containing part and the second containing part; an elastic limiting component surrounding around the second inner electrode is disposed between the annular limiting ring and the electrode cover, one end of the elastic limiting component abuts the annular limiting ring, the other end of the elastic limiting component abuts the electrode cover.

In this embodiment, the elastic limiting component is a spring.

In another embodiment, a fastening protrusion is formed on a bottom wall of the butt-joint groove of the second connection member, and the fastening protrusion is configured to limit the buckle in the buckling groove and prevent the buckle from sliding when the first connection member is connected with the second connection member.

The following beneficial effects can be achieved when implementing the electronic cigarette of the present application. The battery assembly is connected with the atomizing assembly by rotating and buckling, so that users can quickly assemble the battery assembly and the atomizing assembly together, and the rotating-to-buckling connection structure is more stable. This design is ingenious, and can meet various demands of users and improve the user experience.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

To make the objects, technical schemes and advantages more clearly, the present application may be further described in detail with reference to the accompanying drawings and embodiments.

Figure 1:
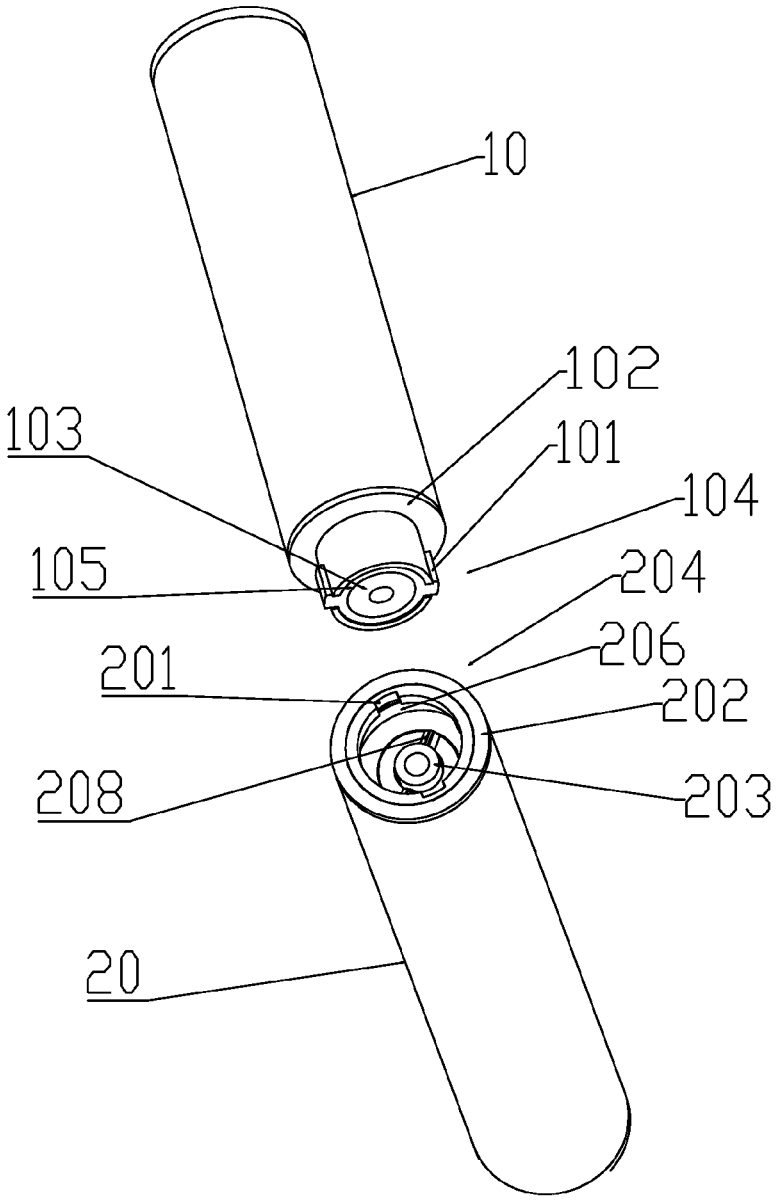
FIG. 1 is a schematic view of an electronic cigarette of a first embodiment of the present application.

Referring to FIG. 1, a preferred embodiment of the present application provides an electronic cigarette. The electronic cigarette includes two assemblies connected together, wherein the two assemblies are an atomizing assembly 10 and a battery assembly 20. A connection structure is mounted at a butt-joint position between the atomizing assembly 10 and the battery assembly 20. The connection structure includes a first connection member 104 and a second connection member 204.

The first connection member 104 includes at least one buckle 101 that radially extends away from a central axis of the first connection member 104. Referring to FIG. 1, the buckle 101 protrudes from the outer side of the first connection member 104.

The second connection member 204 defines a butt-joint groove, and a sidewall of the butt-joint groove defines a guiding groove 201 matching with the buckle 101. A buckling groove 206 is defined in the circumference of one side of the guiding groove 201. The buckling groove 206 communicates with the guiding groove 201 and is configured to enable the buckle 101 to slide therein.

The buckle 101 is inserted into the second connection member 204 along the guiding groove 201 and is rotated along the buckling groove 206 to connect the first connection member 104 with the second connection member 204 fixedly.

Referring to FIG. 1, in this embodiment, the first connection member 104 includes two buckles 101. The two buckles 101 symmetrically protrude from an outer side of the first connection member 104. It should be understood that the number and locations of the buckles 101 are not limited to the number and locations shown in FIG. 1. The buckle 101 can be formed anywhere on the outer side of the first connection member 104, and the number of the buckles 101 can be one or more. Preferably, in order to save material and facilitate manufacturing, in this embodiment, the two buckles 101 positioned symmetrically can ensure the first connection member 104 to be effectively fixed with the second connection member 204. It should be understood that the number of the buckles 101 can also be three or more, and the buckles 101 are preferably positioned symmetrically so as to facilitate manufacturing and ensure reliable connection.

Referring to FIG. 1, the first connection member 104 with the buckle 101 is mounted on one end of the atomizing assembly 10. The second connection member 204 with the guiding groove 201 and the buckling groove 206 is mounted on one end of the battery assembly 20 configured to form the butt-joint with the atomizing assembly 10. Wherein, the guiding groove 201 is matched with the buckle 101, and the buckling groove 206 is configured to enable the buckle 101 to slide therein. By the connection between the first connection member 104 and the second connection member 204, the atomizing assembly 10 is connected with the battery assembly 20 fixedly. It should be understood that the atomizing assembly 10 and the battery assembly 20 can also be connected together though the first connection member 104 is mounted on the battery assembly 20 and the second connection member 204 is mounted on the atomizing assembly 10 correspondingly.

Figure 2:
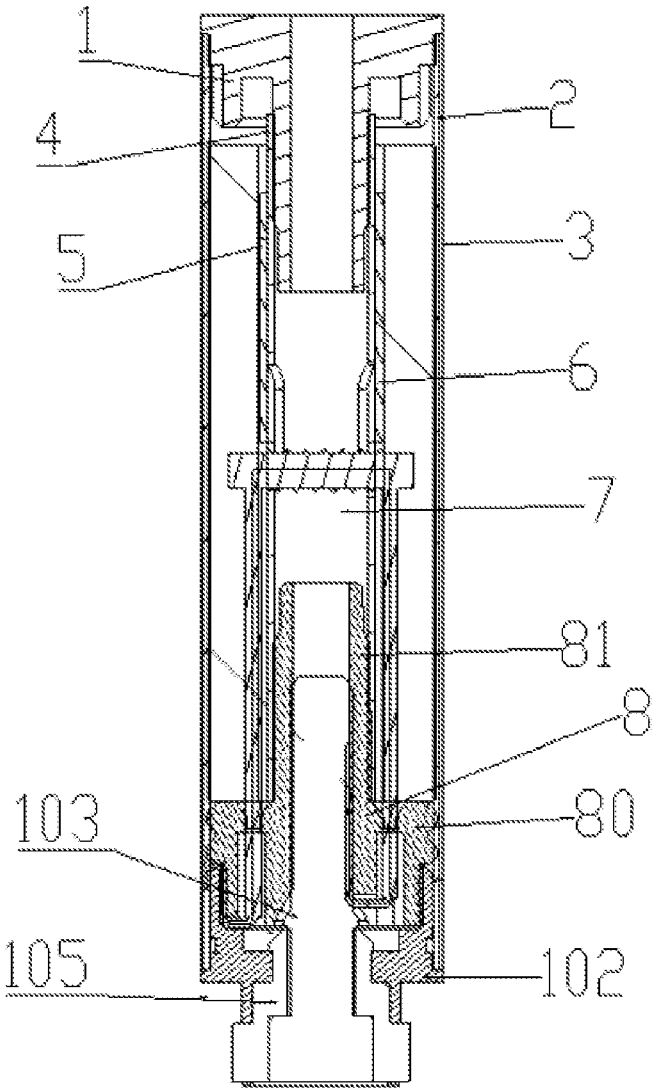
FIG. 2 is a cut-away view of an atomizing assembly of the electronic cigarette shown in FIG. 1.

Referring to FIG. 2, a cut-away view of an atomizing assembly 10 of the first embodiment is shown. The first connection member 104 includes a first outer electrode 102 that is hollow and a first inner electrode 103 that is inserted in the first outer electrode 102. A first insulation member 105 is disposed between the first inner electrode 103 and the first outer electrode 102. At least two buckles 101 protrude from an outer side of the first outer electrode 102. The first outer electrode 102 and the first inner electrode 103 are made of conductive material, such as metal or alloy (e.g., copper, iron, aluminum, zinc, or aluminum alloy, zinc alloy, etc.). The first insulation member is made of insulating material such as plastics, rubber, silicone, macromolecular materials, etc.

Referring to FIG. 2, a nozzle cover 1 is mounted on one end of the atomizing assembly 10 that is away from the first connection member 104. The atomizing assembly 10 includes an atomizer sheath 2. The atomizer sheath 2 is connected with the nozzle cover 1 and the first outer electrode 102 by interference fit respectively. A breathing pipe 4 and an atomizer base 8 are mounted in the atomizer sheath 2 and are orderly arranged along a direction from the nozzle cover 1 to the first connection member 104. A heating assembly 7 for atomizing tobacco tar is accommodated in the breathing pipe 4. The nozzle cover 1 is buckled with the top of the atomizer sheath 2. The connection between the nozzle cover 1 and the atomizer sheath 2 is detachable, for example, the connection may be thread engagement or interference fit. The outer wall of the breathing pipe 4 and the inner wall of the atomizer sheath 2 cooperatively form a tobacco storing cavity (not labeled) for containing tobacco storing cotton 6. A first through-hole (not labeled) for mounting the heating assembly 7 is defined in the breathing pipe 4, so that the heating assembly 7 can heat and atomize the tobacco tar stored in the tobacco storing cotton 6. Besides, at least one layer of paster 3 is pasted on an outer side of the atomizer sheath 2 to insulate heat and imitate a real cigarette.

The first outer electrode 102 is buckled at a distal end of the atomizer sheath 2. As detailed above, the first inner electrode 103 is mounted inside the first outer electrode 102. The first insulation member 105 is disposed between the first outer electrode 102 and the first inner electrode 103. Every adjacent two of the first outer electrode 102, the first insulation member 105, and the first inner electrode 103 are limited by each other, and the limiting method may be interference fit.

The atomizer base 8 includes a bottom base 80 and a main body 81 integrated with the bottom base 80. The bottom base 80 abuts the first outer electrode 102, and the main body 81 is inserted in the breathing pipe 4, so that the breathing pipe 4 is supported by the atomizer base 8. Besides, the atomizer base 8 is hollow and defines an atomizing channel (not shown) communicating with and being coaxial with the breathing pipe 4. A fixing pipe 5 is mounted outside the breathing pipe 4. Two through-holes (not shown) are defined in the bottom base 80 of the atomizer base 8. The heating assembly 7 is electrically connected to the first outer electrode 102 and the first inner electrode 103 via the two through-holes respectively. The first inner electrode 103 runs through the first insulation member 105 and is then inserted into the atomizer base 8. Every adjacent two of the first outer electrode 102, the first insulation member 105, and the first inner electrode 103 are limited by each other, and advantageously, the limiting method may be interference fit.

Figure 3:
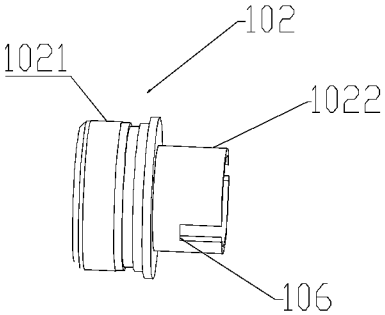
FIG. 3 is a schematic view of a first outer electrode of the electronic cigarette shown in FIG. 2.

Referring FIG. 3, a schematic view of the first outer electrode 102 of the electronic cigarette shown in FIG. 2 is presented. It can be seen from FIG. 3 that the first outer electrode 102 includes a base portion 1021 and a rotate-to-buckle portion 1022. A diameter of the rotate-to-buckle portion 1022 is less than a diameter of the base portion 1021. The base portion 1021 is configured to connect with the bottom base 80 of the atomizer base 8 limitedly, and preferably, the limitedly connection method is interference fit. A first buckling hole or a first buckling recess 106 matched with the buckle 101 is defined in an outer side of the rotate-to-buckle portion 1022. Along an axial direction of the first connection member 104, the first buckling hole or the first buckling recess 106 is apart from the base portion 1021 at a preset distance, and the preset distance corresponds to a length of the guiding groove 201 along a radial direction of the second connection member 204.

Figure 4:
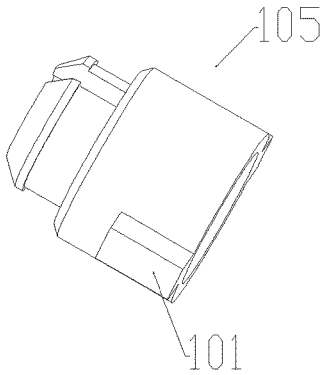
FIG. 4 is a schematic view of a first insulation member of the electronic cigarette shown in FIG. 2.

Referring to FIG. 4, the buckle 101 protrudes from a sidewall of the first insulation member 105 and is integrated with the first insulation member 105. The buckle 101 is further buckled and matched with the first buckling hole or the first buckling recess 106, and then protrudes from an outer wall of the rotate-to-buckle portion 1022. Particularly, all of the at least two buckles 101 protrude from an outer side of the rotate-to-buckle portion 1022. The buckle 101 is inserted and fixed in the first buckling hole or the first buckling recess 106. Therefore, the buckle 101 is apart from the base portion 1021 at the preset distance as well. In order to make the first connection member 104 fitly buckled with the second connection member 204, the buckle 101 is fitted in the guiding groove 201 firstly, and then the buckle 101 is further buckled in the first buckling hole or the first buckling groove 206. Since the preset distance exists between the buckle 101 and the base portion 1021, after the buckle 101 is entirely inserted in the first buckling hole or the first buckling groove 206, the position relation between the buckle 101 and the guiding groove 201 can be changed by the relative rotation between the first connection member 104 and the second connection member 204. Thus, it can be ensured that the buckle 101 is limited in the first buckling hole or the first buckling groove 206 to prevent the buckle 101 from sliding along the guiding groove 201.

Figure 5:
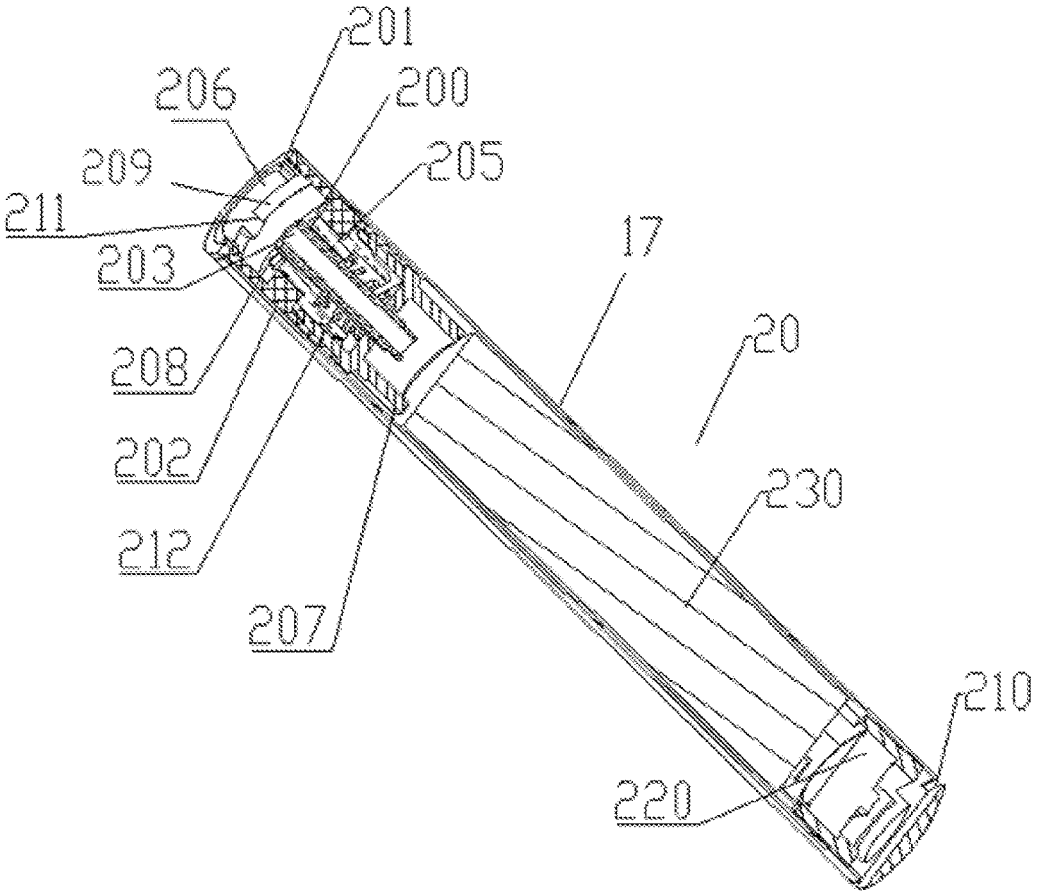
FIG. 5 is a cut-away view of a battery assembly of the electronic cigarette shown in FIG. 1.

Referring to FIG. 5, a cut-away view of the battery assembly 20 of the electronic cigarette of the first embodiment is shown. The battery assembly 20 includes a battery sheath. The second connection member 204 matching with the first connection member 104 is mounted at one end of the battery sheath. A lamp cap 210 is mounted on another end of the battery assembly 20 that is away from the second connection member 204. The connection between the lamp cap 210 and the battery sheath may be interference fit, threaded connection, etc. A battery 230 and a microphone head 220 are mounted in the battery sheath and orderly arranged along a direction from the second connection member 204 to the lamp cap 210. The battery 230 is configured to supply power to the atomizing assembly 10. The microphone head 220 is configured to sense gas flow and control the electronic cigarette to work. The microphone head 220 has a gas flow sensor and a controller integrated therein, which is in the prior art and does not need to be described in detail here.

Referring to FIG. 5, the second connection member 204 includes a second outer electrode 202 that is hollow and a second inner electrode 203 that is inserted in the second outer electrode 202. A second insulation member 205 is disposed between the second inner electrode 203 and the second outer electrode 202. Every adjacent two of the second outer electrode 202, the second insulation member 205, and the second inner electrode 203 are limited by each other, and advantageously, the limiting method may be interference fit. The positive pole of the battery 230 is electrically connected to one of the second outer electrode 202 and the second inner electrode 203, and the negative pole of the battery 230 is electrically connected to the other of the second outer electrode 202 and the second inner electrode 203.

It should be understood that, in one embodiment, the guiding groove 201 corresponding to the buckle 101 is defined along an axial direction of an inner side of the second outer electrode 202, and the buckling groove 206 communicating with the guiding groove 201 is defined along the circumferential direction of an inner side of the second outer electrode 202. Both the guiding groove 201 and the buckling groove 206 are matched with the buckle 101.

Specifically, the guiding groove 201, the buckling groove 206, and the second outer electrode 202 can be formed integrally. Namely, the guiding groove 201 and the buckling groove 206, which are matched with the buckle 101, can be directly formed on an inner wall of the second outer electrode 202, and a circumferential length of the buckling groove 206 with respect to the second outer electrode 202 can be defined according to the practical condition.

Figure 6:
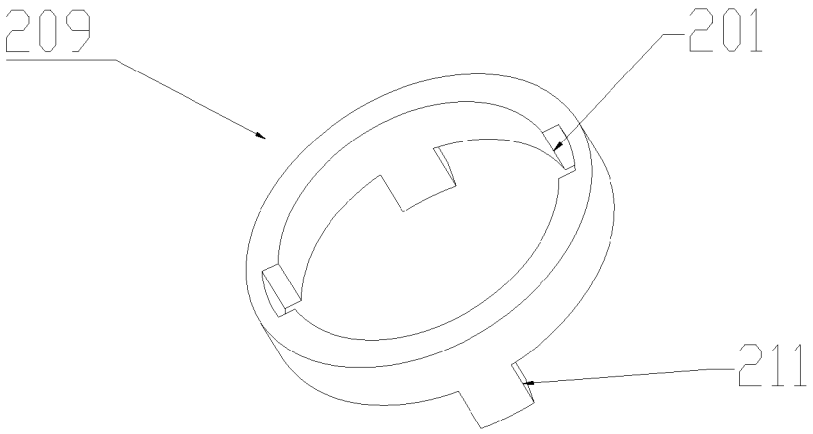
FIG. 6 is a schematic view of a limiting member of the battery assembly shown in FIG. 5.

Referring to FIG. 6, in this embodiment, a limiting member 209 is mounted inside the second outer electrode 202 and configured to form the guiding groove 201 and the buckling groove 206. It can be seen from the cut-away view of a battery assembly 20 in FIG. 2 that the guiding groove 201 matching with the buckle 101 is defined in a part of an inner wall of the limiting member 209 corresponding to the buckle 101. An annular shield ring 200 is accommodated in the second outer electrode 202, and the buckling groove 206 configured for enabling the buckle 101 to slide therein is formed between the annular shield ring 200 and the limiting member 209. It should be understood that the annular shield ring 200 can be integrated with the second outer electrode 202, and can also be accommodated in the second outer electrode 202 by interference fit or the like. When the first connection member 104 is connected with the second connection member 204, the buckle 101 is inserted into the buckling groove 206 defined along the circumferential direction of the second outer electrode 102 along the direction of the guiding groove 201, and the buckle 101 is limited in an axial direction of the battery assembly 20 by the buckling groove 206. Besides, at least two support members 211 extend from one end of the limiting member 209 that is away from an opening of the second outer electrode 202, and the at least two support members 211 are located symmetrically. Each support member 211 is located between adjacent ones of the guiding grooves 201 and configured to limit the buckle 101.

In order to connect one of the positive pole and the negative pole of the battery 230 with one of the second outer electrode 203 and the second inner electrode 202 and connect the other of the positive pole and the negative pole of the battery 230 with the other of the second outer electrode 203 and the second inner electrode 202 more conveniently, in the embodiment, an electrode cover 207 is mounted between the battery 230 and the second connection member 204. Every adjacent two of the second outer electrode 202, the second insulation member 205, and the electrode cover 207 are limitedly connected together by interference fit. An accommodation space for containing the second inner electrode 203 is formed between the electrode cover 207 and the second insulation member 205. The accommodation space includes a first containing part (not shown) near the limiting member 209 and a second containing part near the battery 230. A diameter of the second containing part is larger than a diameter of the first containing part. The second inner electrode 203 runs through the first containing part and the second containing part and is then fixed.

Figure 7:
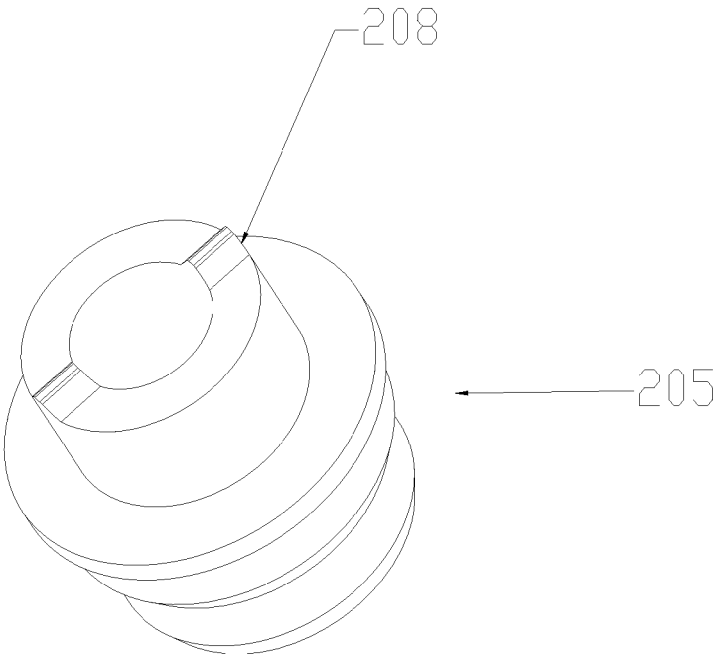
FIG. 7 is a schematic view of a second insulation member of the battery assembly shown in FIG. 5.

Referring to FIG. 7, a fastening protrusion 208 is formed on one end surface of the second insulation member 205 that is adjacent to the limiting member 209. The fastening protrusion 208 is configured to limit the buckle 101 in the buckling groove 206 and prevent the buckle 101 from sliding when the first connection member 104 is connected with the second connection member 204.

Figure 8:
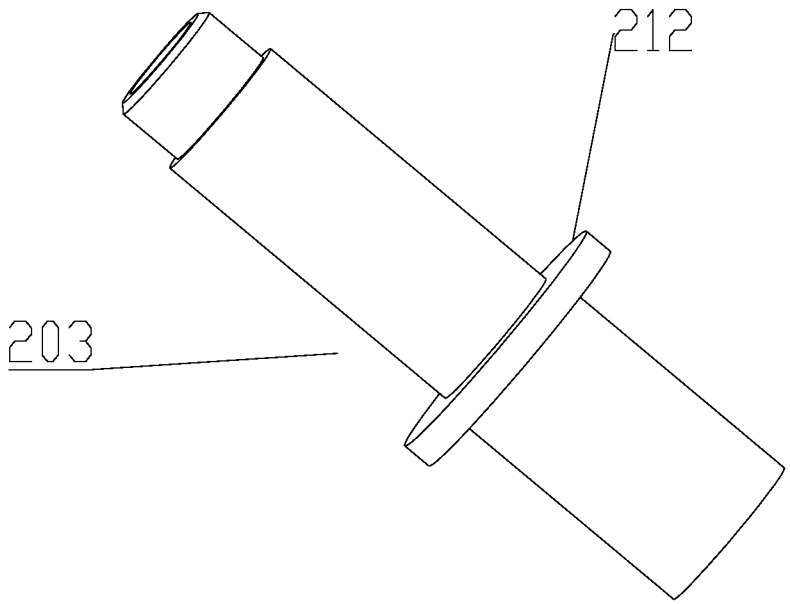
FIG. 8 is a schematic view of a second inner electrode of the battery assembly shown in FIG. 5.

To ensure the effective electronic connection between the first inner electrode 103 and the second inner electrode 203 when the first connection member 104 and the second connection member 204 are rotated to be buckled, an end surface of the second inner electrode 203 that contacts with the first connection member 104 is a little higher than the end surface of the second insulation member 205. Referring to FIG. 8, an annular limiting ring 212 protrudes from an outer side of the second inner electrode 203 and is positioned adjacent to a joint between the first containing part and the second containing part. An elastic limiting component 214 surrounding the second inner electrode 203 is disposed between the annular limiting ring 212 and the electrode cover 207. One end of the elastic limiting component 214 abuts the annular limiting ring 212, and the other end of the elastic limiting component 214 abuts the electrode cover 207. When inserting the first connection member 104 into the second connection member 204, in the process that the buckle 101 is inserted along the guiding groove 201, the first inner electrode 103 abuts the second inner electrode 203 firstly, and the elastic limiting member 214 is compressed to ensure the effective contact connection between the first outer electrode 102 and the second outer electrode 203. After the buckle 201 has entered the buckling groove 206, the atomizing assembly 10 is rotated as a whole, so that the buckle 101 deviates from the position just below the guiding groove 201. The movement of the buckle 101 along the axial direction of the electronic cigarette is limited by the buckling groove 206. In this way, the first connection member 104 and the second connection member 204 are fixed to each other. Preferably, the elastic limiting component is a spring.

Figure 9:
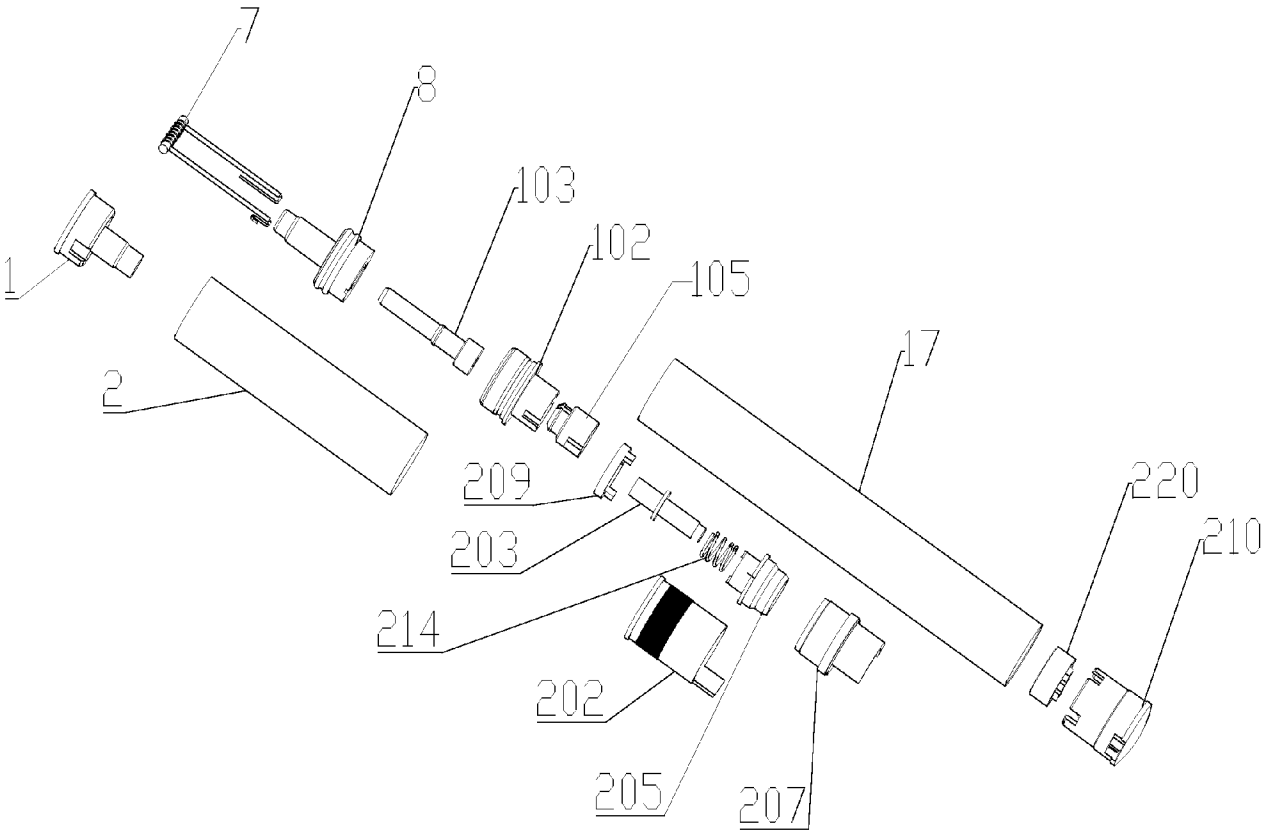
FIG. 9 is an exploded view of the electronic cigarette of the first embodiment of the present application.
Figure 10:
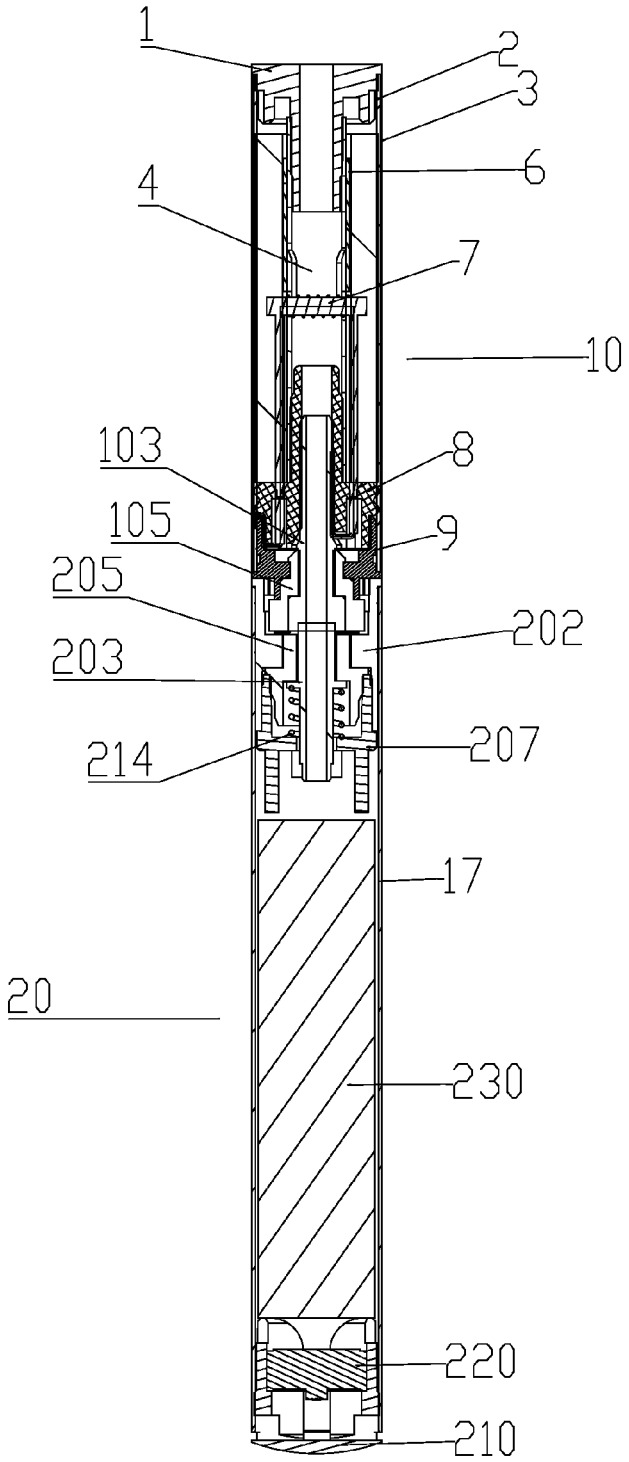
FIG. 10 is a cut-away view of the electronic cigarette of the first embodiment of the present application.

Referring to FIG. 9, an exploded view of the electronic cigarette of the first embodiment of the present application is shown. In the embodiment, both the guiding groove 201 and the buckling groove 206, which are configured to fix the buckle 101, are formed by providing the limiting member 209. FIG. 10 is a cut-away view of the electronic cigarette of the first embodiment of the present application. Referring to FIG. 10, when the electronic cigarette is assembled, the first outer electrode 103 electrically contacts the second outer electrode 203, and the first inner electrode 102 electrically contacts the second inner electrode 202. In this way, the heating assembly 7 is connected with both the positive and negative poles of the battery 230 effectively.

In the electronic cigarette of the present application, a first connection member 104 and a second connection member 204 are respectively mounted on corresponding joint ends of the atomizing assembly 10 and the battery assembly 20. The first connection member 104 includes a buckle 101, and the second connection member 204 includes a guiding groove 201 and a buckling groove 206 both matching with the buckle 101. The atomizing assembly 10 can be effectively connected with the battery assembly 20 by rotating the buckle 101. This connection method is more stable than conventional plug connection, and is more convenient than other conventional connections such as threaded connection. Besides, this connection method conforms to the habit that users generally like to connect the atomizing assembly 10 with the battery assembly 20 by rotating operations. Thus, the electronic cigarette can meet various demands of users, improve the user experience, and benefit for quitting smoking.

While the embodiments of the present application have been described with reference to the drawings, the present application will not be limited to above embodiments that are illustrative but not limitative. It will be understood by those skilled in the art that various changes and equivalents may be substituted in the light of the present application without departing from the scope of the present application, and those various changes and equivalents shall fall into the protection of the application.

What is claimed is:

1. An electronic cigarette comprising an atomizing assembly and a battery assembly connected together; wherein a connection structure is mounted at a butt-joint position between the atomizing assembly and the battery assembly, and the connection structure includes a first connection member and a second connection member;

wherein the first connection member includes a first outer electrode that is hollow and a first inner electrode that is inserted into the first outer electrode, a first insulation member is disposed between the first inner electrode and the first outer electrode, and the first insulation member includes a buckle that radially extends away from a central axis of the first connection member to the outside of the first outer electrode;

wherein the first outer electrode includes a base portion and a rotate-to-buckle portion, a diameter of the rotate-to-buckle portion is less than a diameter of the base portion, and the buckle protrudes from the outside of the rotate-to-buckle portion;

wherein the second connection member includes a second outer electrode that is hollow and comprises an end facing the first connection member and a second inner electrode that is inserted into the second outer electrode, a second insulation member is disposed between the second inner electrode and the second outer electrode, a limiting member matched with the rotate-to-buckle portion is mounted on the end of the second outer electrode facing the first connection member, and a guiding groove matched with the buckle is defined in a part of an inner wall of the limiting member corresponding to the buckle;

wherein an annular shield ring is accommodated in the second outer electrode, and a buckling groove configured for enabling the buckle to slide therein is formed between the annular shield ring and the limiting member, the buckling groove communicates with the guiding groove; and wherein the buckle is inserted into the second connection member along the guiding groove and is rotated along the buckling groove to connect the first connection member with the second connection member fixedly.

2. The electronic cigarette according to claim 1, wherein the first connection member is mounted on the atomizing assembly and the second connection member is mounted on the battery assembly, or the second connection member is mounted on the battery assembly and the first connection member is mounted on the atomizing assembly.

3. The electronic cigarette according to claim 2, wherein a sidewall of the first outer electrode defines a first buckling hole or a first buckling recess, and the buckle runs through the first buckling hole or the first buckling recess and protrudes from the outside of the first outer electrode.

4. The electronic cigarette according to claim 3, wherein the buckle protrudes from a sidewall of the first insulation member and is integrated with the first insulation member, the first buckling hole or the first buckling recess is defined in a part of the rotate-to-buckle portion corresponding to the buckle, the buckle is fastened to and matched with the first buckling hole or the first buckling recess, and the buckle protrudes from an outer wall of the rotate-to-buckle portion.

5. The electronic cigarette according to claim 1, wherein the first connection member is mounted on one end of the atomizing assembly that is near the battery assembly; and the second connection member is mounted on one end of the battery assembly that is near the atomizing assembly.

6. The electronic cigarette according to claim 5, wherein a heating assembly for atomizing tobacco tar is accommodated in the atomizing assembly, and the heating assembly is electrically connected to the first outer electrode and the first inner electrode respectively.

7. The electronic cigarette according to claim 6, wherein the battery assembly includes a battery, the positive pole of the battery is electrically connected to one of the second outer electrode and the second inner electrode, and the negative pole of the battery is electrically connected to the other of the second outer electrode and the second inner electrode.

8. The electronic cigarette according to claim 7, wherein an electrode cover is mounted between the battery and the second inner electrode, and any adjacent two of the second outer electrode, the second insulation member, and the electrode cover are limitedly connected together by interference fit.

* * * * *